US009573716B2

(12) United States Patent
Murray

(10) Patent No.: US 9,573,716 B2
(45) Date of Patent: Feb. 21, 2017

(54) POUCH SUPPORT DEVICE

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/679,369

(22) Filed: Apr. 6, 2015

(65) Prior Publication Data

US 2015/0284122 A1 Oct. 8, 2015

Related U.S. Application Data

(60) Provisional application No. 61/975,402, filed on Apr. 4, 2014.

(51) Int. Cl.

| | |
|---|---|
| ***B65B 67/04*** | (2006.01) |
| ***B65B 43/50*** | (2006.01) |
| ***B65B 43/04*** | (2006.01) |
| ***B65B 43/46*** | (2006.01) |
| ***B65B 43/60*** | (2006.01) |
| ***B65B 3/02*** | (2006.01) |

(52) U.S. Cl.

CPC ..... *B65B 43/50* (2013.01); *B65B 3/02* (2013.01); *B65B 43/04* (2013.01); *B65B 43/465* (2013.01); *B65B 43/60* (2013.01)

(58) Field of Classification Search

CPC ..... B65B 43/465; B65B 43/50; B65B 43/54; B65B 3/003

See application file for complete search history.

(56) References Cited

U.S. PATENT DOCUMENTS

| | | | | |
|---|---|---|---|---|
| 6,742,321 | B2 * | 6/2004 | Gates | B65B 43/465 53/284.7 |
| 2007/0241151 | A1 * | 10/2007 | Murray | B65B 43/465 224/407 |
| 2012/0051971 | A1 * | 3/2012 | Giribona | B65B 3/003 422/63 |
| 2015/0135651 | A1 * | 5/2015 | Murray | B65B 43/32 53/492 |
| 2015/0251791 | A1 * | 9/2015 | Lee | B65B 43/32 53/384.1 |

* cited by examiner

*Primary Examiner* — Amy Sterling

(74) *Attorney, Agent, or Firm* — Dinsmore & Shohl LLP

(57) ABSTRACT

The support device includes a support and a pair of bars spaced apart from each other. The bars include a slot configured to enclose peripheral side edges of a flexible pouch. In one embodiment, the bars are wing shaped and include a first member and a second member. The first member is angled with respect to the second member. The slot extends inwardly from an inner surface of the bar and is disposed between the first and second member. The slot is configured to receive a peripheral side seal of the flexible pouch. The first and second members help keep the body of the pouch within the grips of the gripper. In a second preferred embodiment, the bars are an elongated member. The slot is disposed along the inner surface of the bars. The bars have a length sufficient to receive the side peripheral seal of the pouch.

15 Claims, 8 Drawing Sheets

POUCH SUPPORT DEVICE

CROSS-REFERENCE TO RELATED APPLICATIONS

This application claims priority of U.S. Provisional Application 61/975,402 filed Apr. 4, 2014, the contents of which are incorporated herein by reference.

BACKGROUND OF THE INVENTION

Machines for forming and filling flexible pouches are currently known and used. Some machines include a turret and a rail generally concentric to the turret. A carriage is mounted to the turret. The carriage holds a plurality of grippers. The grippers are paired and each of the grippers includes ends configured to hold a top portion of the flexible pouch so as to position the pouch for pouch finishing operations such as filling, sealing, or fitment insertion. The turret is centrally located among a plurality of work stations.

Each work station may include a plurality of arms configured to perform various operations to the pouch. For instance, one of the work stations may be configured to apply a heat seal to the bottom edge of a pouch. Yet another work station may be configured to open the pouch, and yet another work station may be configured to fill the pouch. As the pouch progresses around the turret and through each of the individual stations, the pouch is filled, sealed, and then transferred to an end point for delivery to a distributor. It should be appreciated that a programmable controller may be in electrical communication with each of the work stations and carriage so as to automatically move the pouch progressively through the work stations. The machine may further include sensors. The sensors may be distributed throughout the work stations so as to inform the controller when a finishing process is complete.

It should be appreciated the pouch may be subject to centrifugal forces as the pouch progresses through the arcuate sections of the turret. In particular, as the pouch is being held at its top side edges by the grippers the centrifugal force of the pouch, as the pouch navigates through a turn, may cause the bottom portion of the pouch to become misaligned with the various stations. Accordingly, it remains desirable to have a support device configured to hold the bottom edges of the pouch in alignment with the grippers so as to maintain proper position of the pouch throughout the various stations, and to stabilize the pouch as the pouch is subjected to centrifugal forces, or forces caused by the stop and start of the pouch between the work stations.

SUMMARY OF THE INVENTION

A support device for use in a machine configured to perform filling and finishing operations to a flexible pouch is provided. The support device includes a support and a pair of bars spaced apart from each other. The bars include a slot configured to enclose peripheral side edges of a flexible pouch. In one embodiment, the bars are wing shaped and include a first member and a second member. The first member is angled with respect to the second member. The slot extends inwardly from an inner surface of the bar and is disposed between the first and second member. The slot is configured to receive a peripheral side seal of the flexible pouch. The first and second members help keep the body of the pouch within the grips of the gripper.

In a second preferred embodiment, the bars are an elongated member. The slot is disposed along the inner surface of the bars. The bars have a length sufficient to receive the side peripheral seal of the pouch.

The device may further include a support actuator. The support actuator is configured to pivot the bars so as to open and close the bars with respect to each other. In the open position, the bars are spaced apart from the peripheral side seal of the pouch. In the closed position, the bars are rotated so as to place the peripheral side seal of the bars within the slot.

A machine for filling and finishing a flexible pouch is also provided. The machine includes a turret. A rail surrounds the turret. The turret includes at least one arcuate portion. The machine includes a carriage mounted to the turret, and configured to move around the turret. A plurality of top grippers is mounted to the carriage. The top grippers are configured to engage a top portion of the pouch in a clamping manner so as to suspend the pouch.

The machine further includes a carriage. The carriage includes a pouch support having a pair of bars. The bars are spaced apart from each other. The bars include a slot configured to enclose peripheral side edges of a flexible pouch.

In one embodiment, the bars are generally "V" shaped and include a first member and a second member. The first member is angled with respect to the second member. The slot extends inwardly from an inner surface of the bar and is disposed between the first and second member. The slot is configured to receive a peripheral side seal of the flexible pouch.

In a second preferred embodiment, the bars are an elongated member. The slot is disposed along the inner surface of the bars. The bars have a length sufficient to receive the side peripheral seal of the pouch.

The bars stabilize the pouch body during the various finishing operations of the pouch. Specifically, the bars help sustain the pouch body in a fixed relationship with respect to the top grippers. This may be useful in that the opening of the pouch is in proper position for operations such as filling, sealing and fitment insertion. The bars are further configured to help stabilize the pouch body as it is subjected to centrifugal forces when the pouch body travels along arcuate portions of the turret.

DETAILED DESCRIPTION OF THE PREFERRED EMBODIMENTS

A carriage having a pair of bars for use in a machine configured to perform operations to fill and seal a pouch is provided. Each bar includes slot a configured to enclose peripheral side edges of a flexible pouch. In one embodiment the bar includes a first member angled with respect to a second member the bar so as to be generally "V" shaped and configured to engage opposite sides of the pouch. The slot extends inwardly from an inner surface of the bar. The slot is disposed between the respective first and second members of the bar. The slot is configured to receive a peripheral side seal of the flexible pouch.

In another embodiment, the bars are an elongated member. The slot is disposed along the inner surface of the bars. The bars have a length sufficient to receive the side peripheral seal of the pouch.

Figure 1:
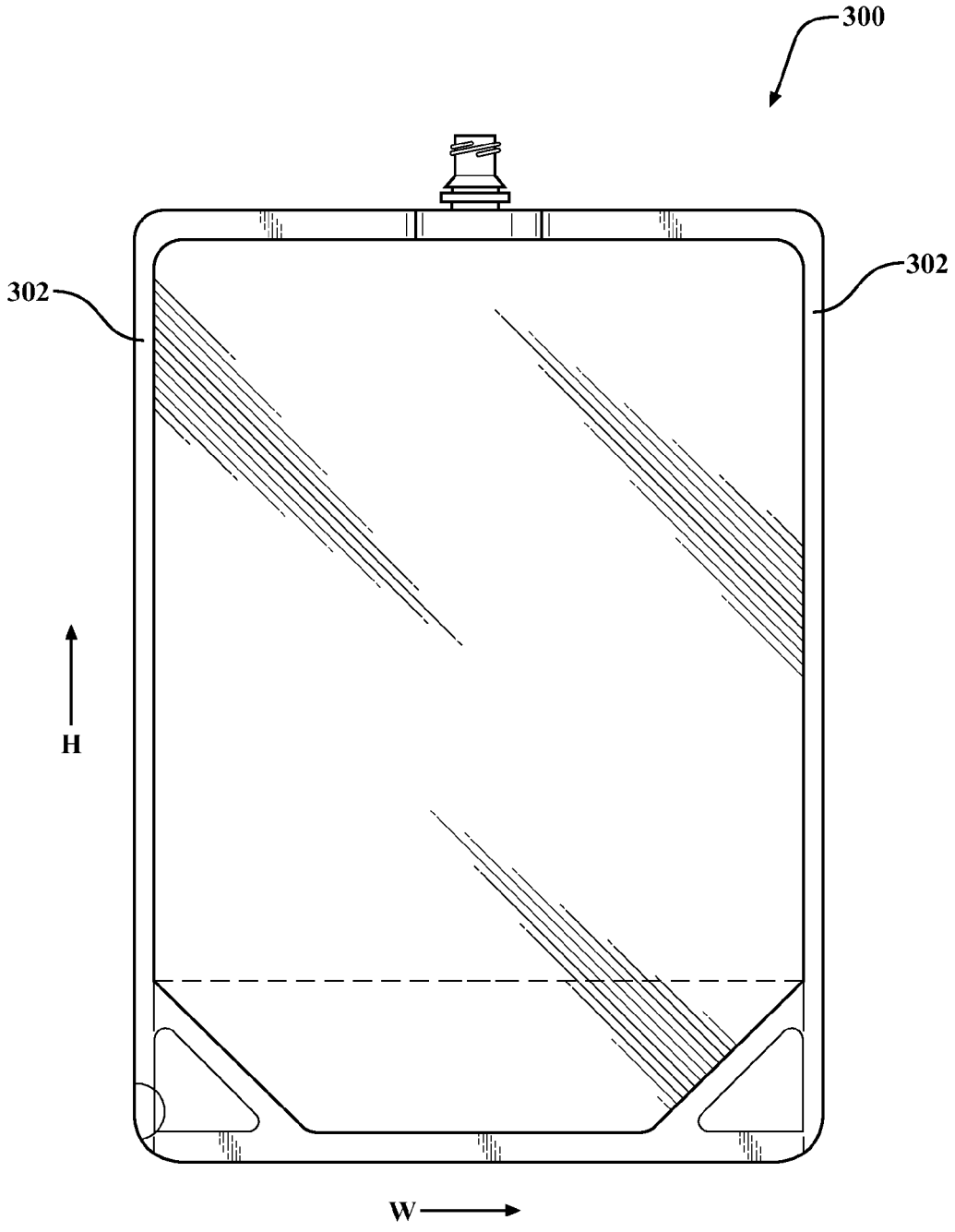
FIG. 1 is an illustrative embodiment of a pouch formed by a machine.

With reference first to FIG. 1, an illustrative example of flexible pouch 300 is provided. The flexible pouch 300 includes a pair of side seals 302 extending along the peripheral side edges, in the "H" direction of the pouch 300. The side seals 302 are generally planar having a width as defined by the letter "W". The side seals 302 are oriented along a vertical axis and extend outwardly along the W axis from the side of the pouch body 304.

Figure 2:
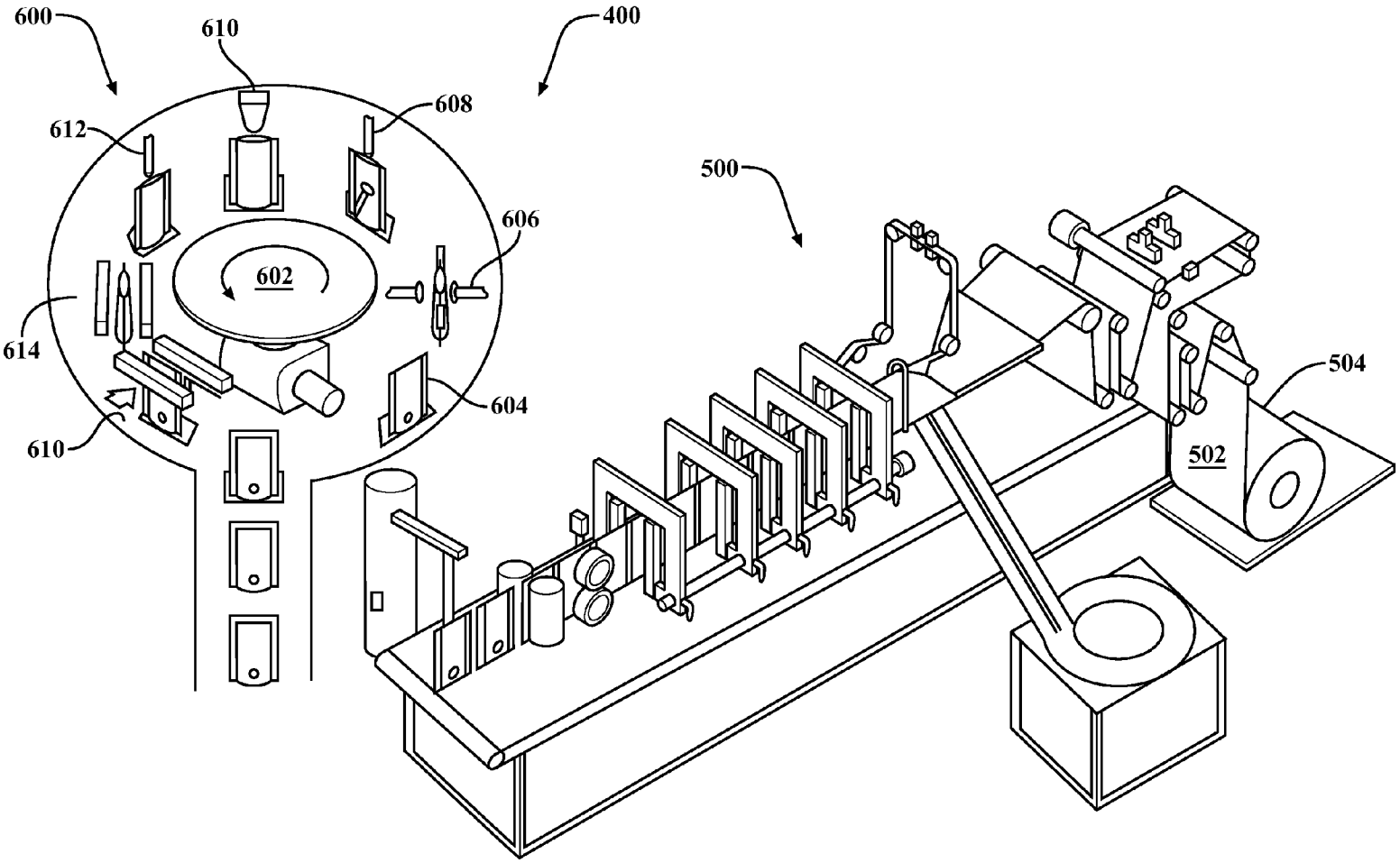
FIG. 2 is an illustrative embodiment showing a machine having a turret and a plurality of stations configured to perform finishing operations.
Figure 3:
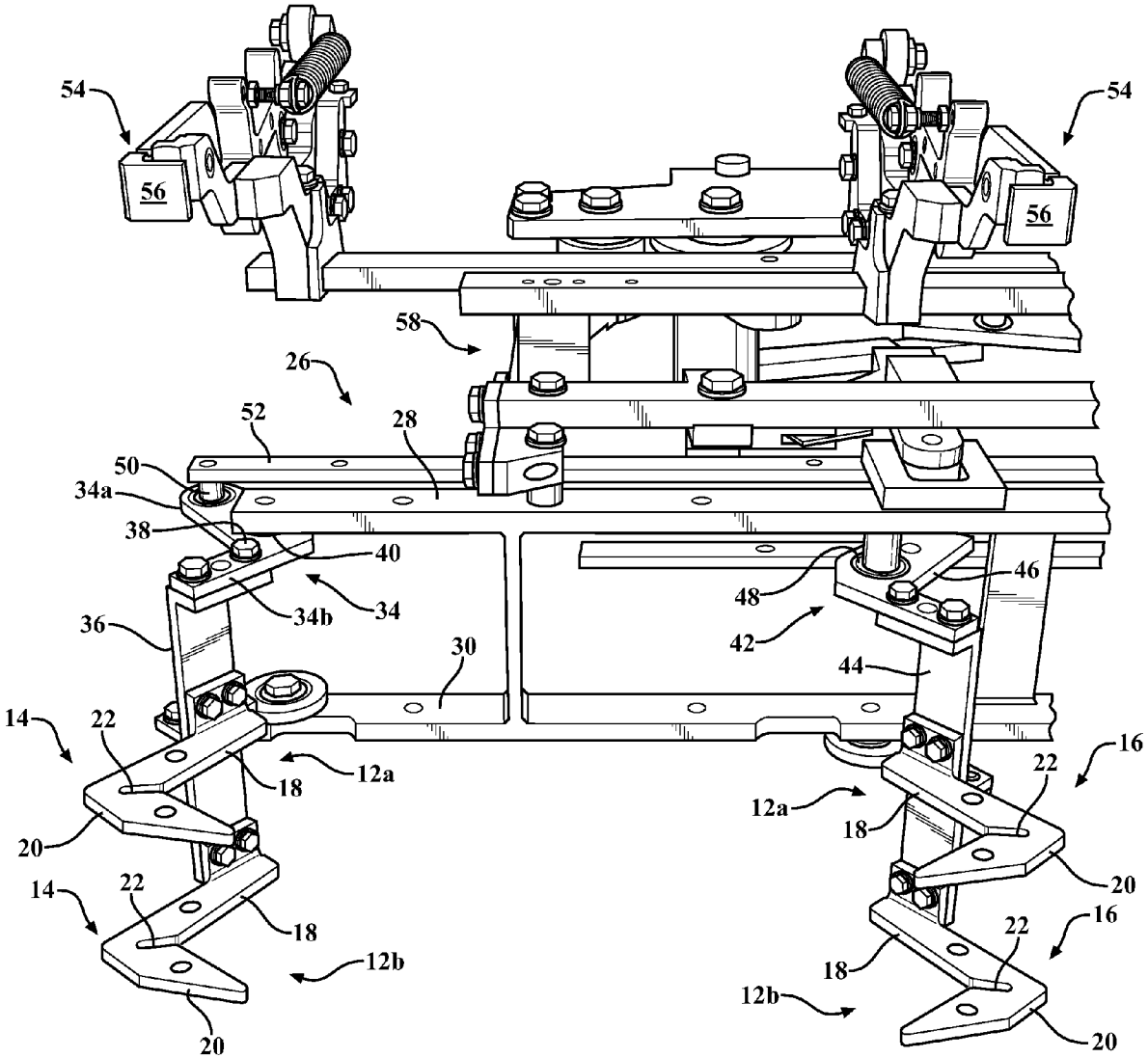
FIG. 3 is an illustrative embodiment of a carriage.
Figure 4:
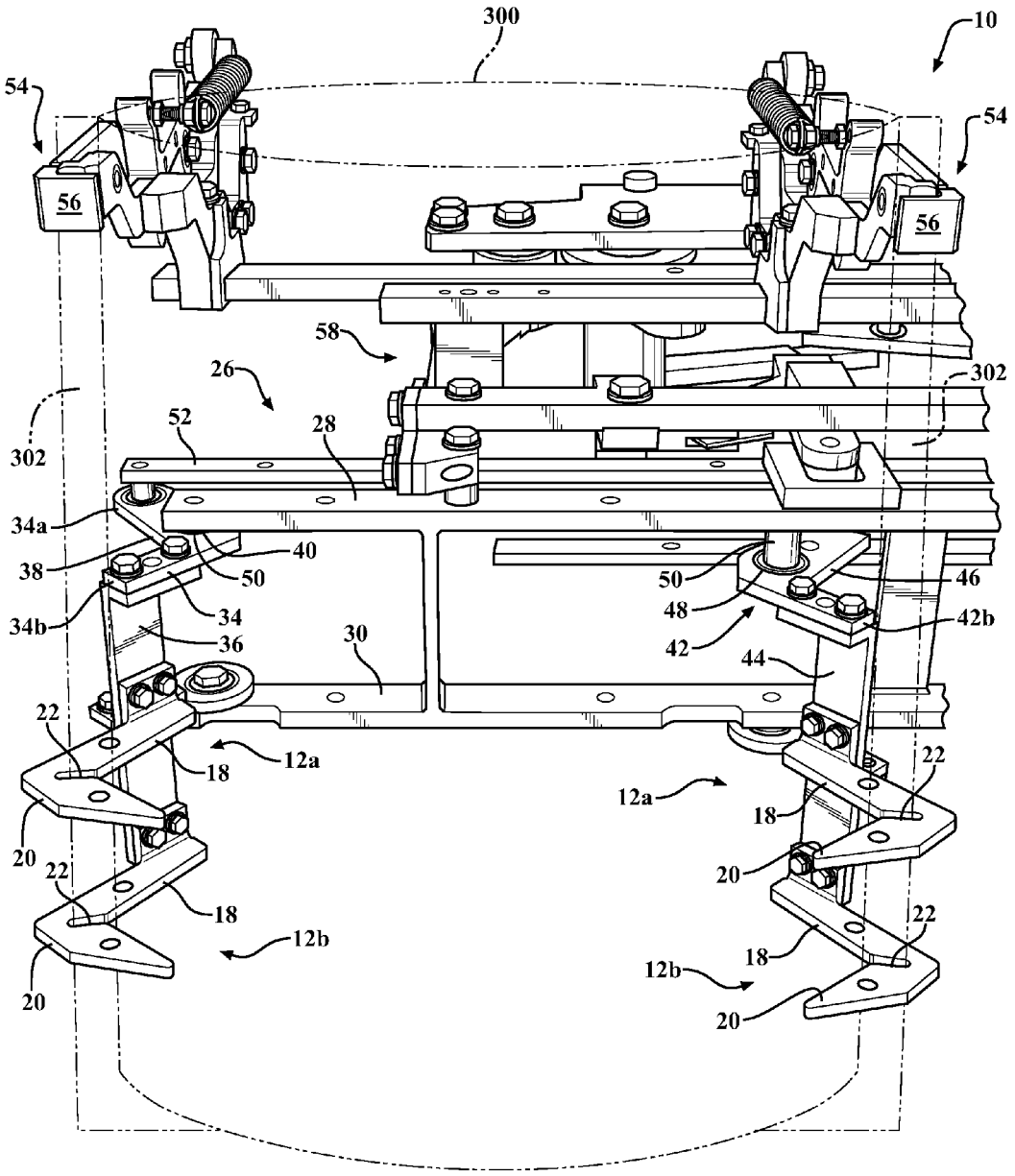
FIG. 4 is a view of the carriage shown in FIG. 3 supporting a pouch.

With reference now to FIG. 2, a machine 400 currently for filling a flexible pouch 300, such as the flexible pouch 300 shown in FIG. 1, is provided. The machine 400 includes a pouch forming station 500 configured to form flexible pouches 300 from sheets of material 502. The sheets of laminate material 502 are brought together from rolls 504, and cutting and sealing operations are performed along the various stations comprising station 500. The stations are arranged generally linearly with respect to each other. At the end of the station 500 the pouch body 300 is formed wherein the top is open at which point a machine 600 configured to perform finishing operations to the pouch 300 is provided. The machine includes a turret 602 which is disposed at the center of generally concentrically arranged work stations 60. For use herein, finishing operations describes processes which are directed towards producing a filled pouch. Such process include, but are not limited to, filling the pouch, adding Radio Frequency Identifying tags, handles, fitments, enclosing the pouch and gas flushing the pouch.

Figure 5:
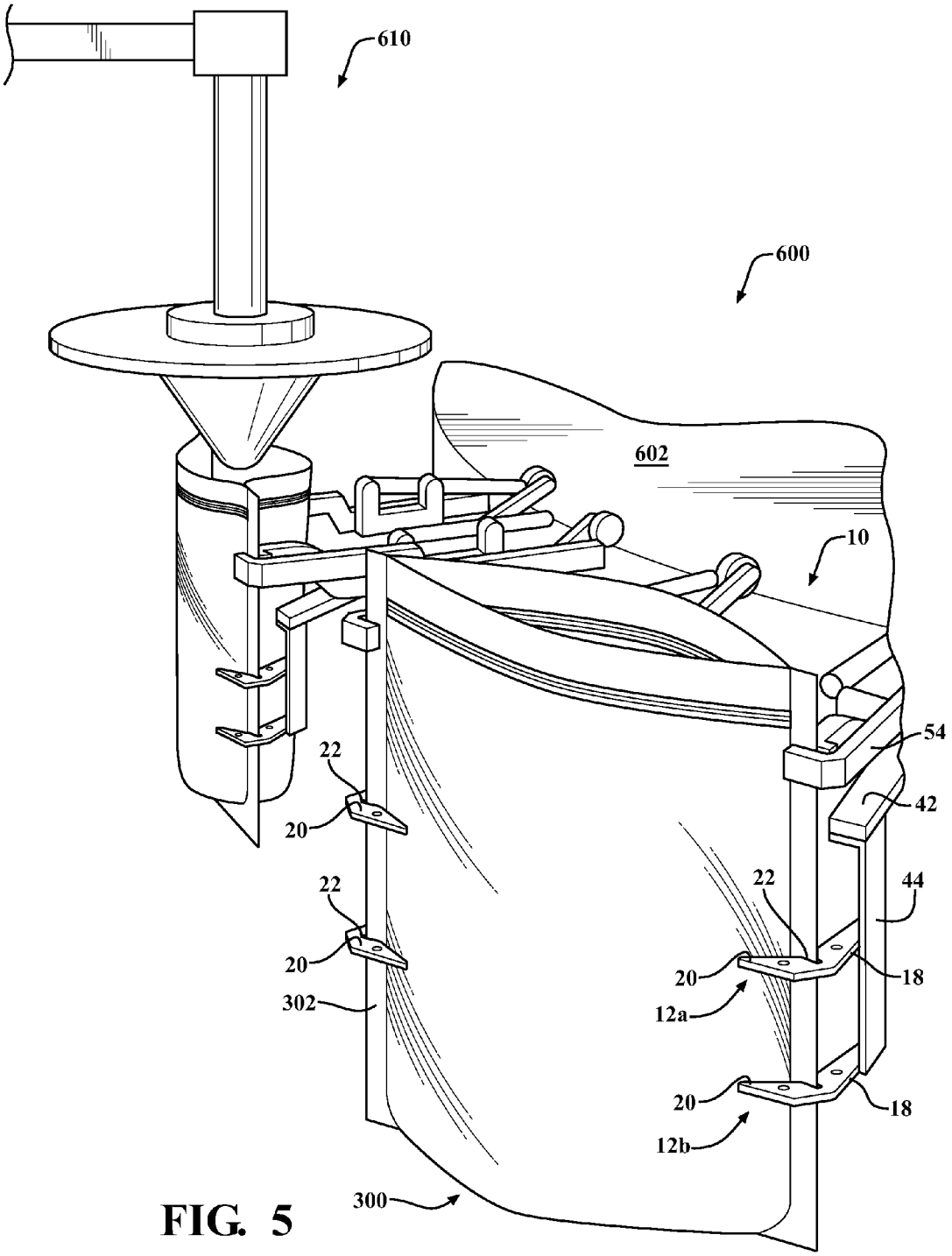
FIG. 5 is an illustrative view of a machine showing the bar supporting a pouch navigating a turn.

With reference now to FIG. 5, an isolated view of a section of machine 600 showing a filling process is provided. The machine 600 includes a turret 602. The turret 602 includes an outer circumferential edge and the work stations 604-616 are concentric to the turret 602. A carriage 24 (illustratively shown in the Figures) is mounted to the turret 602. The turret 602 is configured to move the carriage 24 in a sequential manner to each of the work stations 604-616. The carriage 24 is adapted to hold a top gripper 54. The top gripper 54 is configured to hold pouch 300 by the top edges.

FIG. 5 shows a curved section of the turret 602. It should be appreciated that the speed at which the pouch 300 is carried, may cause the pouch body to be urged away from the turret 602 or momentum may cause the pouch 300 to lurch forward as the carriage stops at a station. This may cause the pouch 300 to slip out of the grippers. Accordingly, there remains a need for a device to help keep the pouch 300 in place during pouch filling and sealing operations.

With reference now to FIGS. 3-6, a first preferred embodiment of the carriage 10 for use in a machine 600 is provided. The carriage includes a pouch support 12. The pouch support 12 includes a first and second bar 14, 16 spaced apart from each other. The pouch support 12 is configured to stabilize the pouch body during transition through turns in the turret so as to counter centrifugal forces.

Preferably, the bars 14, 16 are coplanar. The bars 14, 16 are configured to enclose peripheral side edges of a flexible pouch. The bars 14, 16 are "V" shaped. Each bar 14, 16 includes a first member 18 and a second member 20. The first member 18 is angled with respect to the second member 20. The slot 22 extends inwardly from an inner surface of the respective bar 14, 16 and is disposed between the respective first and second members 18, 20. The slot 22 is configured to receive a peripheral side seal 302 of the flexible pouch 300. The slot 22 of the first bar 14 is generally coaxial with the slot 22 of the second bar 16.

The carriage 10 includes a base 26. The base 26 includes a first elongated member 28 spaced apart from a second elongated member 30. The first elongated member 28 is elevated above the second elongated member 30. Each of the elongated members 28, 30 extends along a generally horizontal plane and is parallel to each other. The first and second bars 14, 16 are pivotally mounted to the base 26.

The carriage 10 may include a first elbow 34 and an elongated support 36 extending downwardly from a distal edge of the first elbow 34. The first elbow 34 includes a bend 38. A proximal end 34*a* of the first elbow 34 is pivotably mounted to the first elongated member 28. The first member 18 is mounted to the elongated support 36, beneath the first elongated member 28.

The second elbow 42 is symmetrical to and opposite the first elbow 34. A second elongated support 44 is disposed on a vertical axis and fixedly mounted to the second elbow 42. The second elbow 42 includes a bend 46. The second bar 16 is mounted to the second elongated support 44, beneath the first elongated member 28.

As shown, the first and second bars 14, 16 are open to each other. The bars 14, 16 are configured to pivot towards each other or away from each other. The bars 14, 16 are configured to pivot about a respective eye 40, 48 and a pin 50 extending downwardly from the first elongated member 28. A drive rod 52 is mounted to the proximal ends of the first and second elbows 34, 42 wherein axial translation of the drive rod 52 rotates the bars 14, 16 either towards each other or away from each other about the eye 40, 48.

The drive rod 52 is movable along an axis from a first position to a second position. A proximal end 34*a* of the first elbow 34 is fixedly mounted to the drive rod 52. The bend 38 of the first elbow 34 is pivotably mounted to the first elongated member 28. A distal end 34*b* of the elbow 34 is fixedly mounted the first elongated support 36. A proximal end 42*a* of the second elbow 42 is fixedly mounted to the drive rod 52. The bend 46 of the second elbow 42 is pivotably mounted to first elongated member 28 and spaced apart from the first elbow 34. A distal end 42*b* of the second elbow 42 is fixedly mounted to the second elongated support 44. Thus, movement of the drive rod from a first position to a second position pivots the first and second bars 14, 16 between an open and a closed position.

Though the Figures show the carriage 26 supporting two pouch supports 12*a*, 12*b*, namely an upper pouch support 12*a* and a lower pouch support 12*b*, it should be appreciated that the carriage 26 may only support a single pouch support 12 or may include additional supports 12. The number of supports 12 may be based upon engineering design and the operating parameters of the machine 600. The first bar 14 of both the upper and lower pouch support 12*a*, 12*b* are mounted to the first elongated support 36. The second bar 16 of both the upper and lower pouch support 12*a*, 12*b* are mounted to the second elongated support 44.

The carriage 10 may further include a support actuator (not shown). The support actuator is configured to pivot the bars 14, 16 so as to open and close the bars 14, 16, by axially displacing drive rod 52, with respect to each other. The support actuator may be mounted to the carriage 26. The support actuator may be programmed so as to open the bars to receive a pouch, and also to close the bars so as to hold the pouch body in between the bars throughout movement of the pouch body along the rail.

The support device 10 may be used in conjunction with a top gripper 54. The top gripper 54 is configured to hold the pouch 300 in suspension. The top gripper 54 is coupled to the carriage 26. The carriage 26 is configured to move the top gripper 54 and the support device 10 around the turret to a plurality of work stations. The top gripper 54 may be configured so as to articulate in three-dimensional space wherein the top gripper 54 may be moved automatically so as to engage a top edge of the open pouch 300. The top of the pouch is kept open by a pair of pinchers 56 which secure the top edge of the open pouch. The top gripper 54 may be further configured to articulate the pouch so as to slide the peripheral side edges of the pouch 300 in between a pair of bars 14, 16.

The carriage 26 may further include an upper stand 58. The upper stand 58 is mechanically coupled to the first elongated member 28. The upper stand 58 includes a pair of top grippers 54. The top grippers 54 include a plurality of links and may be articulated in three-dimensional space so as to engage a top edge of the pouch body 300. The pair of top grippers work in concert with each other to place a pouch within the opening of a pair of bars 14, 16. Specifically, the top grippers 54 may be configured to position the peripheral side edges 302 of the pouch 300 within the slots 22 of the bar 14, 16 so as to hold the pouch body 300 and support the pouch body 300 during pouch finishing operations wherein engagement of the peripheral side edges 302 within the slots 22 prevents movement caused by centrifugal force of the pouch body 300 along curved/arcuate portions of the rail.

Figure 6:
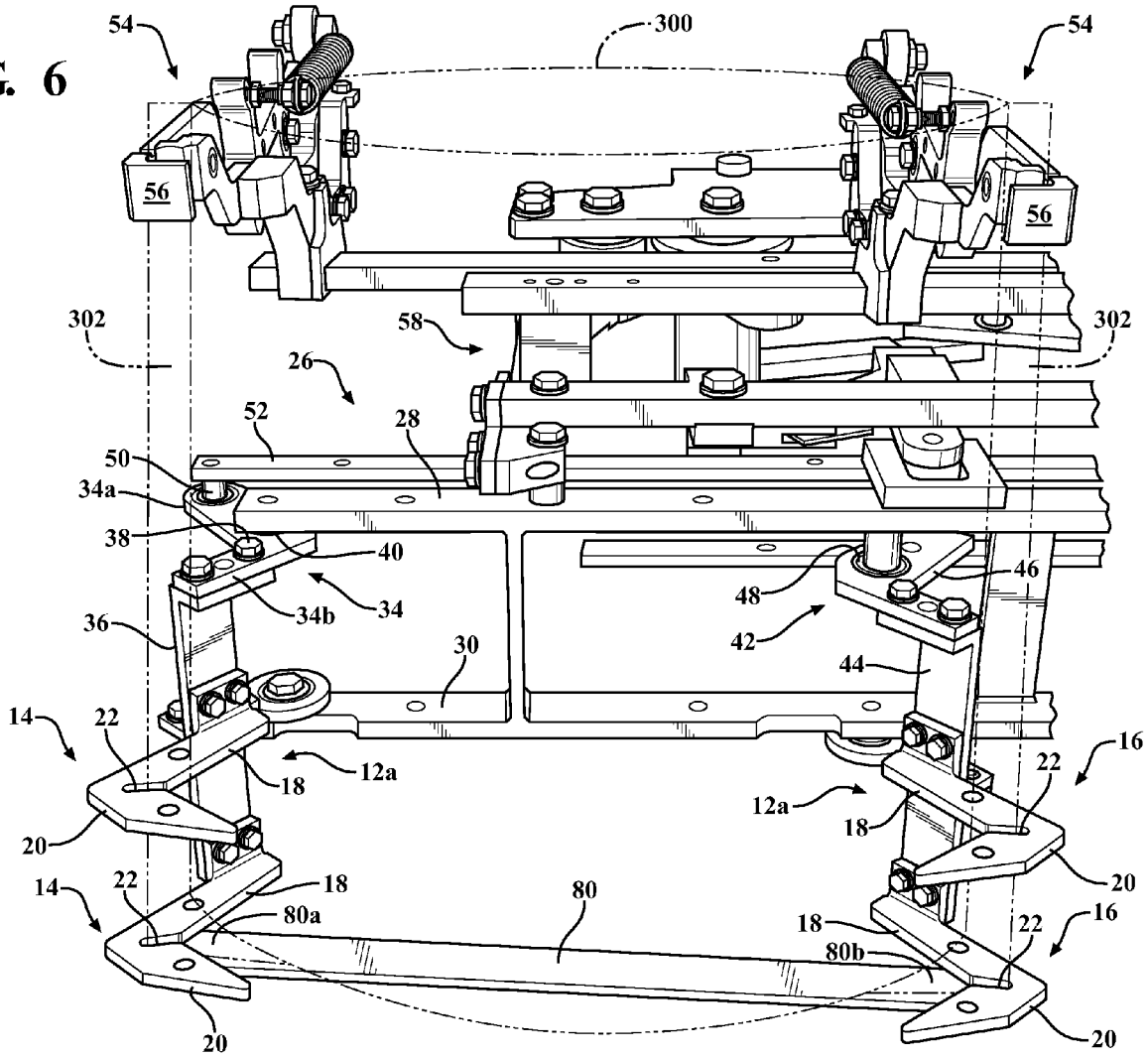
FIG. 6 is an illustrative embodiment of a bar showing the bottom support.

With reference now to FIG. 6, an illustrative illustration of the carriage 10 having a bottom support 80 is provided. The bottom support 80 is shown mounted to the lower pouch support 12*b*. The bottom support 80 is a generally rigid elongated member configured to support the weight of the pouch 300. One end 80*a* of the bottom support 80 is mounted to the first bar 14 of the lower pouch support 12*b*. The other end 80*b* of the bottom support 80 is mounted to the second bar 16 of the lower pouch support 12*b*.

Figure 7:
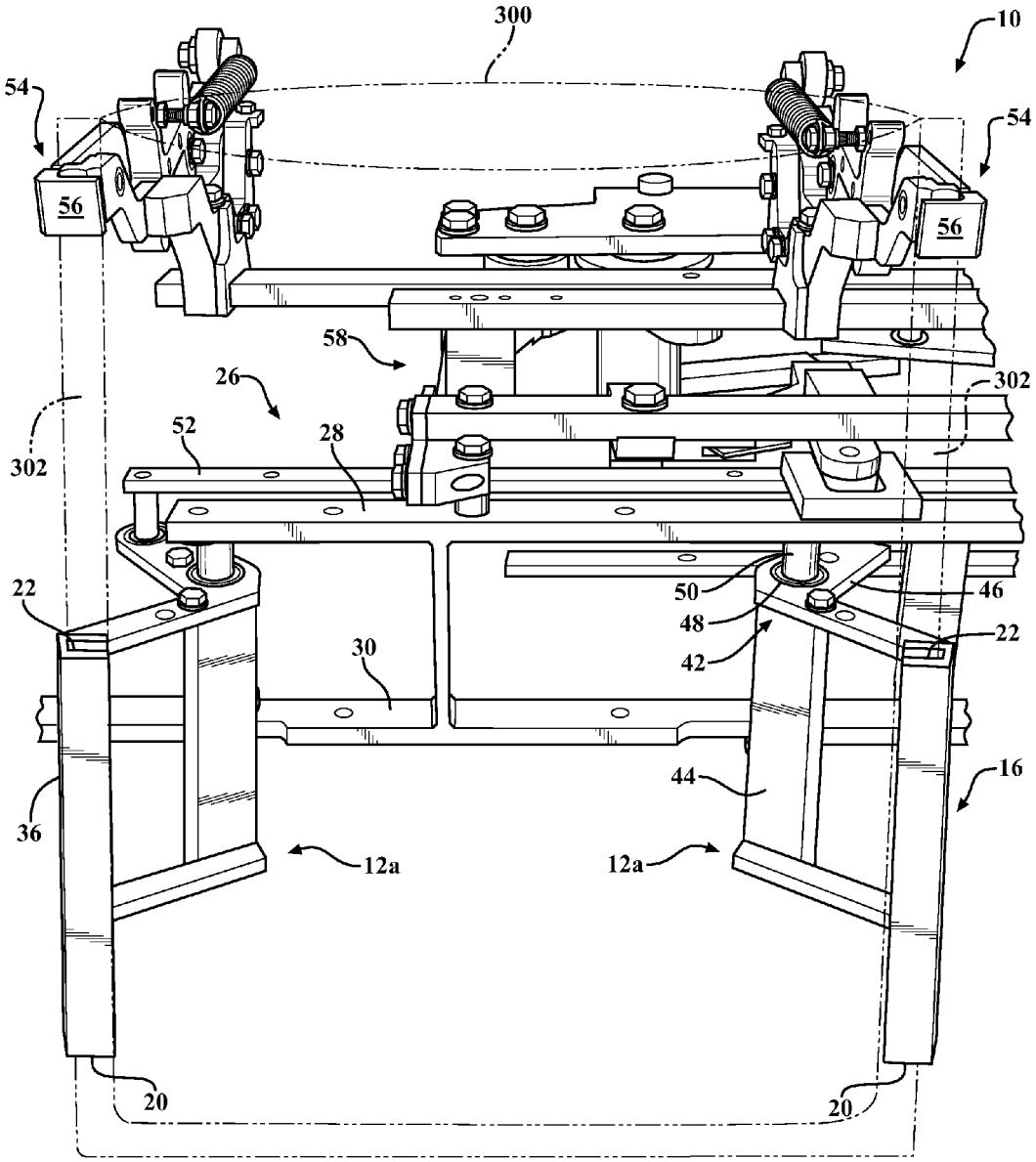
FIG. 7 is an illustrative view of a second preferred embodiment of the bar mounted to a carrier.
Figure 8:
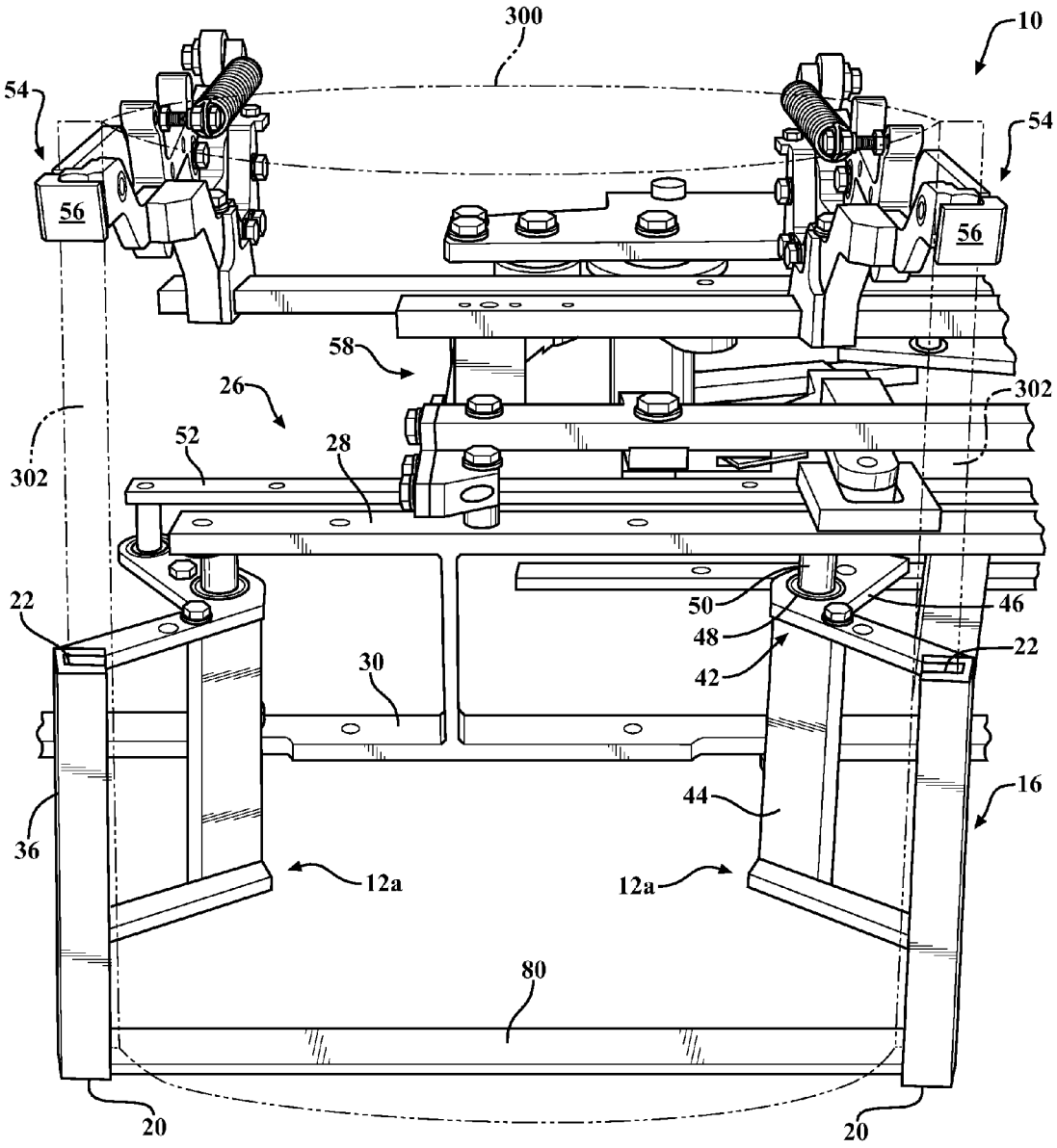
FIG. 8 is an isolated view of the bar shown in FIG. 7.

With reference now to FIGS. 7 and 8, a second preferred embodiment of the carriage 10 is provided wherein like elements are referenced by like numbers increased by 100. In a second preferred embodiment, the pouch support 112 includes a pair of spaced apart bars 114, 116. The bars 114, 116 are an elongated member. The slot 122 is disposed along the inner surface of the bars 114, 116 so as to have the bars 114, 116 open to each other. The bars 114, 116 have a length sufficient to receive the side peripheral seal 302 of the pouch 300.

The bars 114, 116 are configured to pivot towards each other or away from each other. The bars 114, 116 are configured to pivot about a respective eye 140, 148 and a pin 150 extending downwardly from the first elongated member 128. A drive rod 152 is mounted to the proximal ends of the first and second elbows 134, 142 wherein axial translation of the drive rod 152 rotates the bars 114, 116 either towards each other or away from each other about the eye 140, 148.

The drive rod 152 is movable along an axis from a first position to a second position. A proximal end 134*a* of the first elbow 134 is fixedly mounted to the drive rod 152. The bend 138 of the first elbow 134 is pivotably mounted to the first elongated member 128. The first bar 114 is fixedly mounted to the distal end 134*b* of the elbow. A proximal end 142*a* of the second elbow 142 is fixedly mounted to the drive rod 152. The bend 146 of the second elbow 142 is pivotably mounted to first elongated member 128 and spaced apart from the first elbow 134. The second bar 116 is fixedly mounted to the distal end distal end 142*b* of the second elbow 142. Thus, movement of the drive rod from a first position to a second position pivots the first and second bars 114, 116 between an open and a closed position.

With reference now to FIG. 8, the carriage 110 may further include a bottom support 180. The bottom support 180 is shown mounted to the lower end of each bar 114, 116. The bottom support 180 is a generally rigid elongated member configured to support the weight of the pouch 300. One end 180*a* of the bottom support 80 is mounted to the first bar 114. The other end 180*b* of the bottom support 180 is mounted to the second bar 116.

With reference now to FIG. 2, a machine for performing finishing operations to a pouch is also provided. The machine includes a turret, and carriage 26. Carriage 26 includes support device 10, and a top gripper. The support device 10 includes a pouch support 12. The support device 10 includes pouch support 12 having a first and second bar 14, 16 spaced apart from each other. The pouch support 12 is configured to stabilize the pouch body during transition through turns in the turret so as to counter centrifugal forces.

Preferably, the bars 14, 16 are coplanar. The bars 14, 16 are configured to enclose peripheral side edges of a flexible pouch. The bars 14, 16 are "V" shaped. Each bar 14, 16 includes a first member 18 and a second member 20. The first member 18 is angled with respect to the second member 20. Each bar 14, 16 further includes a slot 22. The slot 22 extends inwardly from an inner surface of the respective bar 14, 16 and is disposed between the respective first and second members 14, 16. The slot 22 is configured to receive a peripheral side seal 302 of the flexible pouch 300.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

I claim:

1. A carriage for use in a machine configured to perform operations to fill and seal a pouch, the pouch having a peripheral side seal, the machine having a turret for transporting the pouch to one of a plurality of stations, each one of the plurality of stations configured to perform a work function on the pouch, the carriage mounted to the turret and configured to move around the turret, the carriage comprising:

a pouch support, the pouch support having a first bar spaced apart from a second bar, each of the first and second bar having a slot configured to receive the peripheral side seal of the pouch, the slot extending inwardly and separating the first member from the second member, wherein the first bar and the second bar each include a first member angled relative to a second member so as to form a generally "V" shaped dimension, the first member being in a fixed relationship with the second member, the slot extends inwardly from an inner surface of each of the first bar and second bar so as to be open to each other; and a top gripper configured to engage the pouch in suspension.

2. The carriage as set forth in claim 1, further including a base, the base having a first elongated member spaced apart from a second elongated member, the first elongated member elevated above the second elongated member, the first elongated member and the second elongated member disposed on a generally horizontal axis.

3. The carriage as set forth in claim 1, wherein the first and second bar are pivotably mounted to the carriage.

4. The carriage as set forth in claim 3, further including a pair of elongated supports, and wherein the pouch support is an upper pouch support and a lower pouch support, wherein the first bar of both the upper pouch support and lower pouch support are mounted to one of the pair of elongated supports, and the second bar of both the upper pouch support and lower pouch support are mounted to the other of the pair of elongated support.

5. The carriage as set forth in claim 4, further including a drive rod, the drive rod movable along an axis from a first position to a second position, a first elbow and a second elbow, a proximal end of the first elbow is fixedly mounted to the drive rod, a bend of the first elbow is pivotably mounted to the first elongated member, and a distal end of the elbow fixedly mounted to one of the pair of elongated supports and wherein a proximal end of the second elbow is fixedly mounted to the drive rod, a bend of the second elbow is pivotably mounted to the second elongated member, and a distal end of the elbow fixedly mounted to one of the pair of elongated supports, wherein movement of the drive rod from a first position to a second position pivots the first and second bar between an open and a closed position.

6. The carriage as set forth in claim 1, wherein the first and second bar are coplanar, and wherein the slot of the first bar is coaxial with the slot of the second bar.

7. The carriage as set forth in claim 2, further including a bottom support, the bottom support configured to support the weight of the pouch.

8. The carriage as set forth in claim 7, wherein the bottom support is shown mounted to the pouch support.

9. The carriage as set forth in claim 8, wherein the bottom support is an elongated member having opposing ends, wherein one end of the bottom support is mounted to the first bar and the other end of the bottom support is mounted to the second bar.

10. The carriage as set forth in claim 1, wherein the first bar and the second bar have an elongated body and a slot, the slot is disposed on the inner surface of the first bar and the second bar so as have the first bar and the second bar be open to each other.

11. The carriage as set forth in claim 10, further including a base, the base having a first elongated member spaced apart from a second elongated member, the first elongated member elevated above the second elongated member, the first elongated member and the second elongated member disposed on a generally horizontal axis.

12. The carriage as set forth in claim 11, wherein the first and second bars are pivotably mounted to the carriage.

13. The carriage as set forth in claim 12, further including a drive rod, the drive rod movable along an axis from a first position to a second position, a first elbow and a second elbow, a proximal end of the first elbow is fixedly mounted to the drive rod, a bend of the first elbow is pivotably mounted to the first elongated member, and the first bar is fixedly mounted to a distal end of the first elbow and wherein a proximal end of the second elbow is fixedly mounted to the drive rod, a bend of the second elbow is pivotably mounted to the second elongated member, and the second bar is fixedly mounted to a distal end of the second elbow, wherein movement of the drive rod from a first position to a second position pivots the first and second bars between an open and a closed position.

14. The carriage as set forth in claim 13, further including a bottom support, the bottom support configured to support the weight of the pouch.

15. The carriage as set forth in claim 1, further including a bottom support, the bottom support configured to support the weight of the pouch.

* * * * *